US006359595B1

(12) United States Patent
Abraham et al.

(10) Patent No.: US 6,359,595 B1
(45) Date of Patent: Mar. 19, 2002

(54) FLAT PLATE ANTENNA

(75) Inventors: Ian A Abraham, Herts; Roger A Perrott, Essex, both of (GB)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/559,853

(22) Filed: Apr. 27, 2000

(51) Int. Cl.[7] ..... H01Q 1/38
(52) U.S. Cl. ..... 343/778; 343/770
(58) Field of Search ..... 343/778, 700 MS, 343/770, 767

(56) References Cited

U.S. PATENT DOCUMENTS 4,486,758 A 12/1984 de Ronde ..... 343/700 MS
4,614,947 A 9/1986 Rammos ..... 343/778
4,623,893 A * 11/1986 Sabban ..... 343/700 MS
4,958,165 A * 9/1990 Axford et al. ..... 343/770
5,355,143 A * 10/1994 Zurcher et al. ..... 343/700 MS

* cited by examiner

*Primary Examiner*—Don Wong
*Assistant Examiner*—James Clinger
(74) *Attorney, Agent, or Firm*—Lee, Mann, Smith, McWilliams, Sweeney & Ohlson

(57) ABSTRACT

The present invention relates to a microwave flat plate or planar antenna, and a method of manufacturing the same. As the frequency of operation increases, traditional methods of manufacturing these antennas are becoming increasingly impractical. The present invention provides an antenna tri-plate structure comprising, a first dielectric layer carrying a plurality of radiating elements, a second and third dielectric layer each comprising a metallised surface having a plurality of apertures corresponding to said radiating elements, a number of dielectrics spacers formed with said second and third dielectric layers, each said spacer being located between a said aperture and a said radiating element to maintain said layers apart.

7 Claims, 3 Drawing Sheets

FLAT PLATE ANTENNA

FIELD OF THE INVENTION

The present invention relates to a microwave flat plate or planar antenna, and a method of manufacturing the same. The invention particularly, but not exclusively, relates to a tri-plate antenna structure.

BACKGROUND OF THE INVENTION

Flat plate microwave antennas are an alternative to the more traditional parabolic or dish style of antenna, and typically provide a more compact, lightweight and cheaper design. Flat plate antennas typically comprise an array of radiating elements disposed in a plane, and one or two ground planes located above and below the radiating element plane, and each having a number of apertures located to correspond with the radiating elements.

U.S. Pat. No. 4,486,758 (de Ronde) discloses such a planar antenna which utilises a solid dielectric material to position the radiating element plane between the ground planes. This arrangement has the disadvantage of using high loss solid dielectric which reduces the antenna efficiency, together with the additional weight which this material represents. An alternative approach is to use a point distribution positioning method to space the radiating elements from the ground planes as disclosed in U.S. Pat. No. 4,614,947 (Rammos). In this arrangement, the radiating elements are carried on a dielectric sheet, which is separated from the ground planes by discrete spacers formed by embossments in the metal plates forming the two ground planes. However this type of arrangement is complex and costly to manufacture.

A more recent advance in this field is to use continuous foam spacers between the radiating elements and the ground planes. The use of these foam spacers is advantageous in that it has a relatively low dielectric loss constant as well as a low weight, and also allows the manufacture of ground planes without embossed spacers or separate spacer components thereby considerably reducing the cost of production of these antennas making mass production of flat plate antennas feasible. While foam spaced flat plate antennas work well at frequencies in the range of 6–12 GHz, when scaling these constructions to operate at higher frequencies new difficulties are encountered. For example the thickness of the foam spacer has to be reduced from about 1 mm for a Ku band system (6–12 GHz) to 0.4mm for a 30 GHz system, with a corresponding decrease in tolerance. It is difficult to produce and work with foam sheets of this thickness, making foam spacers impractical in flat plate antennas operating at these frequencies. In addition the relative density of a thinner foam is likely to increase, due to smaller bubbles and an increased sidewall to bubble volume ratio, resulting in more dielectric losses. The proportion of open cells is also likely-to increase, leading to problems with water absorption.

With the increasing importance of broadband service provision using wireless access technologies, there is a need for an improved flat plate antenna design which operates at frequencies exceeding 12 GHz but is also relatively cheap to produce and lightweight and easy to work with.

SUMMARY OF THE INVENTION

It is an object of the present invention to provide an improved flat plate antenna.

It is a further object of the present invention to provide an improved method of manufacturing flat plate antennas.

In a first aspect the present invention provides an antenna structure comprising:

a first dielectric layer carrying a plurality of probes;

a second dielectric layer comprising a metallised surface having a plurality of apertures corresponding to said probes, each aperture and probe forming a radiating element; and;

a number of dielectric spacers formed with said second dielectric layer, each said spacer being located between a said aperture and a said probe to maintain said layers apart.

Preferably spacers are embossed in the second dielectric layer.

Preferably the antenna structure further comprises a third dielectric layer comprising a metallised surface having a plurality of apertures corresponding to said probes and the apertures of the second dielectric layer, the first dielectric layer being located between the second and third dielectric layers.

Preferably said metallised surface is on the side closest to the first dielectric layer.

In a second aspect the present invention provides an antenna tri-plate structure comprising:

a first dielectric layer carrying a plurality of radiating elements;

a second and third dielectric layer each comprising a metallised surface having a plurality of apertures corresponding to said radiating elements;

a number of dielectrics spacers formed with said second and third dielectric layers, each said spacer being located between a said aperture and a said radiating element to maintain said layers apart In a third aspect the present invention provides a method of manufacturing an antenna structure comprising:

forming spacers on a dielectric layer;

forming a metallised surface on said layer, said surface having a plurality of apertures;

locating said layer on a second dielectric layer carrying a plurality of radiating elements corresponding to said apertures, wherein each said spacer is located between a said aperture and a said radiating element to maintain said layers apart.

Preferably said forming comprises embossing the first dielectric layer.

Detailed Description of the Drawings

The invention will now be described in detail with reference to the following drawings, by way of example only and without intending to be limiting, in which.

Detailed Description

Figure 1:
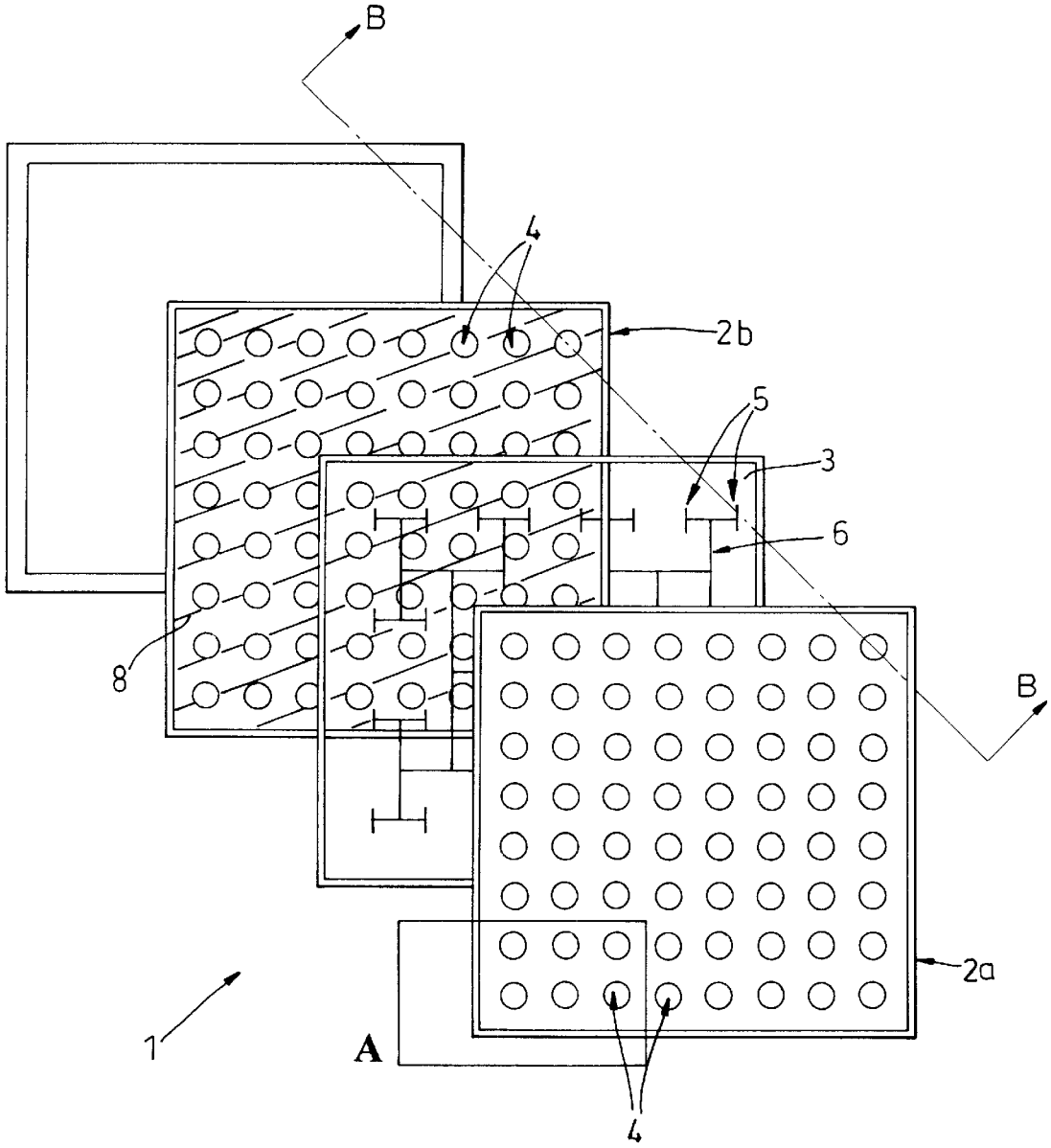
FIG. 1 is an exploded view of a tri-plate version of an antenna structure according to the present invention.
Figure 2:
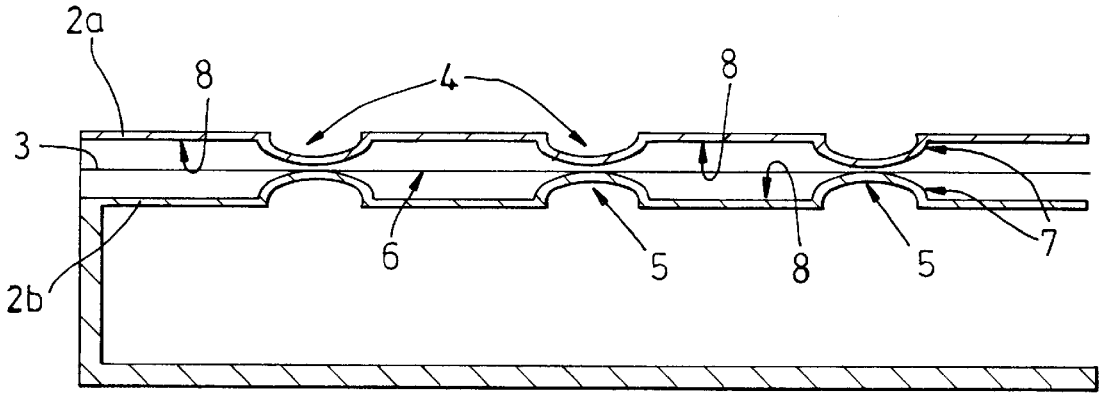
FIG. 2 is a cross-section through rectangle A of FIG. 1.

A preferred embodiment antenna structure 1 according to the invention is shown in FIGS. 1 and 2, and comprises three substantially parallel dielectric layers 2*a*, 2*b* and 3. A first dielectric layer 3 is diposed between a second 2*a* and a third 2*b* dielectric layers, the first dielectric layer 3 carrying a plurality of probes 5 coupled to a feeder network 6 comprising a plurality of conducting tracks as is known in the art.

The second 2*a* and third 2*b* dielectric layers each comprise a metallised surface 8, each forming a ground plane. The ground planes 8 each comprise a number of apertures 4 which correspond in position to the probes 5 such that a probe 5 and two apertures 4 are coaxially located on an axis for example B extending perpendicularly to the three layers 2*a*, 2*b* and 3. The probes 5 and their corresponding apertures 4 together form the radiating elements 10 of the antenna.

In the preferred embodiment, the three dielectric layers 2*a*, 2*b* and 3 are spaced apart by a plurality of spacers 7 in the form of bosses formed in each of the second 2*a* and third 2*b* dielectric layers, the bosses being formed at the apertures 4 in the metallisation 8 such that they rest upon the first dielectric 3 at the location of a probe 5. The spacers 7 are preferably formed by embossing the second 2*a* and third 2*b* dielectric layers. The metallisation 8 on these layers 2*a* and 2*b* is arranged such that the apertures 4 coincide with the spacers 7.

Preferably the dielectric material of the second 2*a* and third 2*b* layers is polyester film. Such a material is easily embossed and metallised and thereby forms a cheap and effective material for this tri-plate structure 1. The polyester can be deformed by pressing at elevated temperatures. Numerous other materials could alternatively be used as is known in the art. These materials should have thermal and mechanical stability, ease of embossing, surface smoothness, ease of plating and low weight. Low dielectric loss is also desirable.

Preferably the dielectric material of the first dielectric layer 3 is polyamide (for example Kapton) or polyester (for example Mylar), although numerous other materials are suitable as is known in the art.

Figure 3:
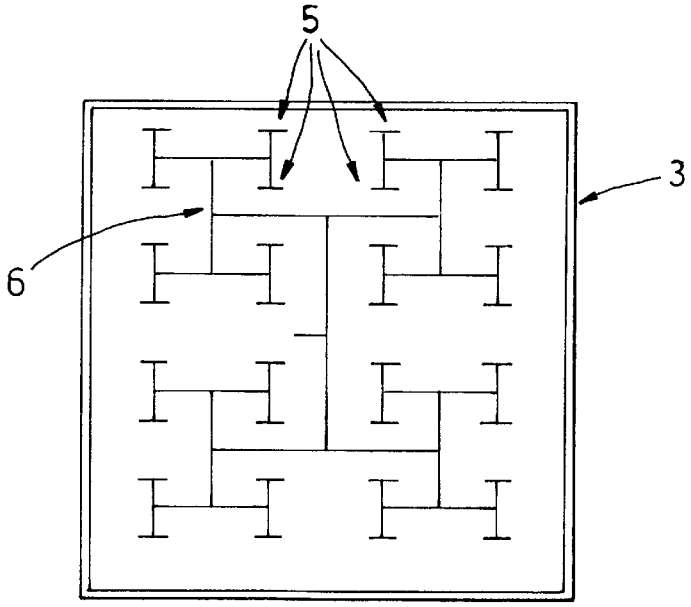
FIG. 3 is a plan view of the probes and feeder network for the structure of FIG. 1.
Figure 4:
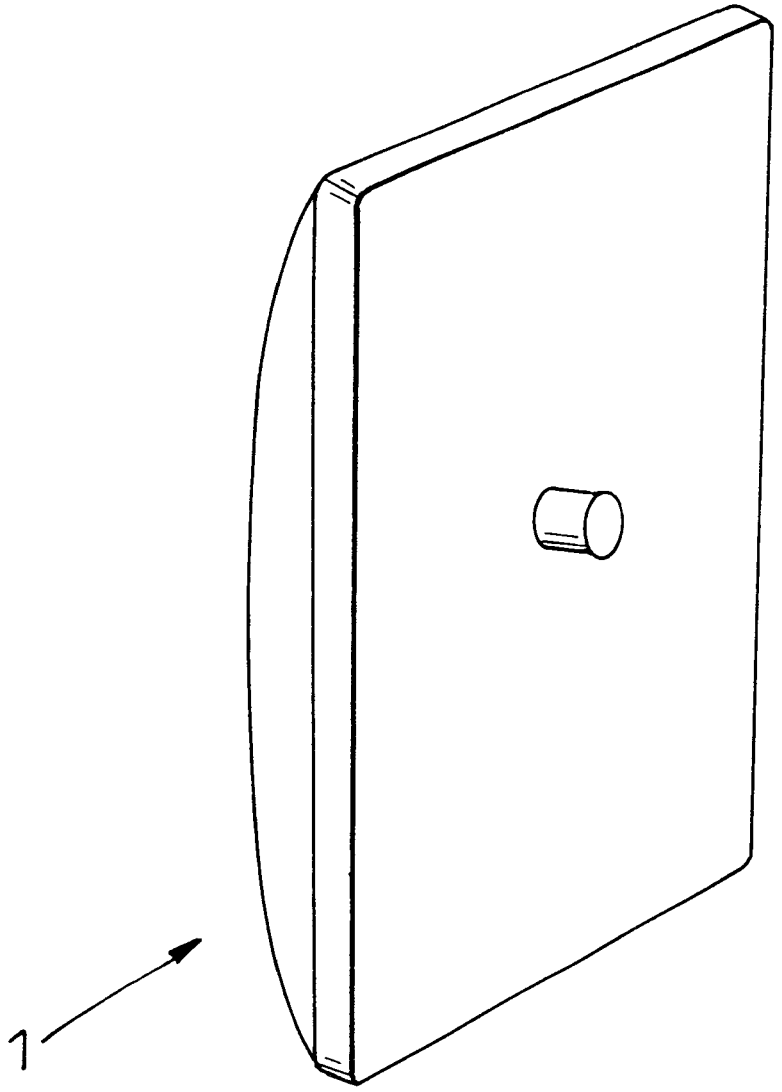
FIG. 4 is a schematic of a completed flat plate antenna

Preferably the metallisation surface 8 on the dielectric layers 2*a* and 2*b* is formed by printing a conducting surface over it, with conductor omitted at sites corresponding to probes. The metallisations surface 8 can alternatively be produced using a subtractive process such as etching. During assembly, the three layers 2*a*, 3 and 2*b* can be laid on top of each other, aligning the spacers 7 such that they coincide with the radiating elements 5. In this way, each radiating element 5 has two apertures 4, one above and one below it. The spacers 7 maintain ground plane separation without using any of the available space for the beamformer. Placing the spacers 7 in the antenna element apertures allows the maximum space on the inner layer 3 for the antenna distribution circuitry. This becomes progressively more important with increased frequency of operation. Preferably the insides of the two outer layers 2*a* and 2*b* are metallised, that is the sides closest to the inner layer 3. This arrangement further reduces antenna losses and hence increases efficiencies. However the outsides of the two outer layers 2*a* and 2*b* may alternatively be metallised as a further alternative both sides of the outer layers 2*a* and 2*b* may be metallised. Preferably the apertures 4 are circular although other shapes such as squares could also be used. Preferably the radiating elements 10 are circular apertures fed by a probe as shown in FIGS. 1,2 and 3. While the probes 5 shown are linear such as track terminations of the feeder network 6 extending into the volume defined by two corresponding apertures 4, other probe sizes and shapes could alternatively be used.

While the preferred radiating elements are circular apertures 4 fed by circular or linear probes 5, other types of radiating elements could alternatively by used such as rectangular slots or a slot coupled patch.

FIG. 3 shows a typical layout of probes 5 and a feeder network 6 which is carried on the first dielectric layer 3. The first dielectric layer 3 can be any thin dielectric material such as discussed above. The feeder network 6 is arranged such that the length of track to each probe is the same such that the signal to or from the radiating elements is in phase.

As discussed above, some prior art arrangements have utilised discrete point spacers such as described in U.S. Pat. No. 4,614,947 for example in which discrete spacers are stamped out of a metal sheet which is then placed onto the film or layer carrying the radiating elements and feeder network. In these arrangements, care has to be taken to locate the stamped spacers in an area where no probes or feeder network tracks existed, or otherwise a short circuit between the ground plane and the feeder network results. As the frequency of operation increases the spacings between probes reduces and as a result of this the feeder network tracks 6 and probes 5 take up more and more space on the central dielectric layer 3 leaving no space for conventional metallic spacers. While solid dielectric spacers have been used, these were always located away from the metallised portions of the central or suspended dielectric layer in a flat plate antenna due to the electromagnetic influence they had on the circuit. In addition to this electromagnetic influence, such solid dielectric spaces have a high dielectric loss and therefore have to be located away from the radiating elements of the antennas.

Existing foam spaced antenna designs suffer from dielectric losses and poor dimensional tolerance, particularly as the frequency of antenna operation increases. The ground planes require additional punched metal parts, increasing the parts count, cost and weight of the antenna. The improved tolerances from use of embossed spacers offers the potential of reducing ground plane spacing to achieve lower impedance or allow denser circuit routing.

A completed flat plate antenna arrangement will typically include the tri-plate structure 1 of FIGS. 1 and 2 together with a metallic back plane or plate (not shown) located a quarter wavelength from the radiating elements 5. These components are then normally enclosed in a plastic housing to provide a lightweight, cheap and convenient antenna arrangement.

Such an antenna arrangement is particularly suited to broadband, satellite and fixed radio access applications requiring high operational frequencies such as 30 GHz for example. In a further example, these antennas may also be used internally within communications equipment to facilitate communication between various components within this equipment such as component boards or racks within a cabinet of such boards. This reduces the need for internal cabling within the equipment cabinet.

While the invention has been described in detail with reference to an antenna structure comprising three dielectric layers, in an alternative arrangement, an antenna structure for an antenna may be constructed of two dielectric layers 2*a* and 3, the first dielectric layer 3 carrying the probes 5 and feeder network 6, and the second dielectric layer 2*a* carrying a metallised ground plane 8 having apertures 4 corresponding to the probes 5.

Preferably the ground plane layers 2*a* and 2*b* are formed with spacers 7 using the process developed by Poly-Flex Circuits of Dodnor Lane Industrial Estate, Newport, Isle of Wight, United Kingdom. which has previously been used for the manufacture of flexible waterproof covers for keypads, This process is well established for low cost high volume production. Preferably the conducting surface 8 is printed onto layers 2*a* and 2*b* prior to forming the spacers, although an etching process could alternatively be used.

While the preferred embodiment has been described as having a spacer associated with each probe and aperture pair, an antenna structure can also be constructed in which spacers are only utilised at some of the probe and aperture pairs.

Preferably the probes 5 are linear in that they are extensions of the network feeder track 6 into the radiating element defined by the probes and apertures. Alternatively the probes 5 may comprise track of expanded width and/or be comprised of different shapes such as circular areas of metallisation. In a further alternative, the probe dimensions may be that of a patch, preferably of square cross-section each side being half the wavelength of the frequency of operations. The term probe is intended to incorporate all of these variations and other arrangements as would be obvious to those skilled in the art.

The invention has been described with reference to preferred embodiments thereof. Alterations and modifications as would be obvious to those skilled in the art are intended to be incorporated within the scope hereof.

What is claimed is:

1. An antenna structure comprising:

a first dielectric layer carrying a plurality of probes;

a second dielectric layer comprising a metallised surface having a plurality of apertures each located to correspond with a said probe to form a radiating element; and at least two separate or individual dielectric spacers formed with said second dielectric layer each located between a said corresponding aperture and probe to maintain said layers apart.

2. An antenna structure as claimed in claim 1 wherein said spacers are embossed deformations in the second dielectric layer.

3. An antenna structure as claimed in claim 1 further comprising a third dielectric layer comprising a metallised surface having a plurality of apertures corresponding to said probes and the apertures of the second dielectric layer, the first dielectric layer being located between the second and third dielectric layers.

4. An antenna structure as claimed in claim 1 wherein said metallised surface is on the side closest to the first dielectric layer.

5. An antenna tri-plate structure comprising:

a first dielectric layer carrying a plurality of radiating elements;

a second and third dielectric layer each comprising a metallised surface having a plurality of apertures corresponding to said radiating elements;

a number of dielectrics spacers formed with said second and third dielectric layers, each said spacer being located between a said aperture and a said radiating element to maintain said layers apart.

6. A method of manufacturing an antenna structure comprising:

forming at least two separate or individual spacers on a dielectric layer;

forming a metallised surface on said layer, said surface having a plurality of apertures; and locating said layer on a second dielectric layer carrying a plurality of radiating elements corresponding to said apertures, wherein each said spacer is located between a said aperture and a said radiating element to maintain said layers apart.

7. A method as claimed in claim 6 wherein said forming comprises embossing the first dielectric layer.

* * * * *